United States Patent [19]

Waterman, Jr.

[11] Patent Number: 4,512,101

[45] Date of Patent: Apr. 23, 1985

[54] RIFLE BUTTSTOCK ASSEMBLY

[75] Inventor: Harold J. Waterman, Jr., Wallingford, Conn.

[73] Assignee: Chandler Evans Inc., West Hartford, Conn.

[21] Appl. No.: 543,342

[22] Filed: Oct. 19, 1983

[51] Int. Cl.[3] ..... F41C 23/00; F41C 21/18

[52] U.S. Cl. ..... 42/71 R; 42/74

[58] Field of Search ..... 42/1 V, 71 R, 74; 89/198

[56] References Cited

U.S. PATENT DOCUMENTS 3,366,011 1/1968 Sturtevant ..... 89/198

3,618,248 11/1971 Into et al. ..... 42/71 R

*Primary Examiner*—Charles T. Jordan

*Assistant Examiner*—Ted L. Parr

*Attorney, Agent, or Firm*—Radford W. Luther; Richard A. Dornon

[57] ABSTRACT

A buttstock (32) for a rifle with a lower receiver extension (20) has a shell (36) of high impact plastic and a molded foam core (52) which defines a stowage compartment (62). The shell includes a longitudinally extending web (48) of semi-circular cross-section which together with the inner periphery of the upper portion shell defines a cylindrical volume (50) for receiving the receiver extension. The web serves to more evenly distribute impact loads to the lower receiver (12) of the rifle when the rifle is impacted through the buttstock, generally strengthens the buttstock and facilitates the flow of core material during the molding process.

3 Claims, 9 Drawing Figures

RIFLE BUTTSTOCK ASSEMBLY

TECHNICAL FIELD

This invention relates to buttstock constructions for firearms.

BACKGROUND ART

The buttstock assembly presently employed in connection with the M-16 rifle, which is illustrated in U.S. Pat. No. 3,618,248, embodies an exterior shell and a molded core therein which defines a cylindrical through volume or aperture extending longitudinally along the top of the buttstock and a centrally located stowage compartment. The cylindrical aperture received lower receiver extension in which a buffer assembly is mounted and the stowage compartment accommodates cleaning and servicing equipment necessary to maintain the rifle. The lower receiver extension is threadably secured to an attachment ring integral with the lower receiver.

The basic difficulty with the aforedescribed buttstock is that certain parts in the lower receiver are subjected to concentrated loads when the buttstock of the rifle is subject to impact loading. For example, when the buttstock engages the ground with substantial impact, the attachment ring has a tendency to fail.

DISCLOSURE OF INVENTION

In accordance with the invention, a buttstock is provided which is similar in construction to the previously described buttstock but embodies a longitudinally extending web which forms part of the shell and defines the cylindrical aperture and increases the strength of the buttstock. It has been found that the provision of such a web allows more even loading of the parts in the lower receiver extension such that the attachment ring will not fail when the buttstock is subjected to impact loads. Moreover, the web significantly improves the flow of core material during the molding process.

Accordingly, it is a primary object of the invention to provide a buttstock assembly for a rifle which allows for more even transmission of loads to the lower receiver.

This and other objects and advantages of the invention will become more readily apparent from the following detailed description when taken in conjunction with the accompanying drawings, in which:

BEST MODE OF CARRYING OUT THE INVENTION

Figure 1:
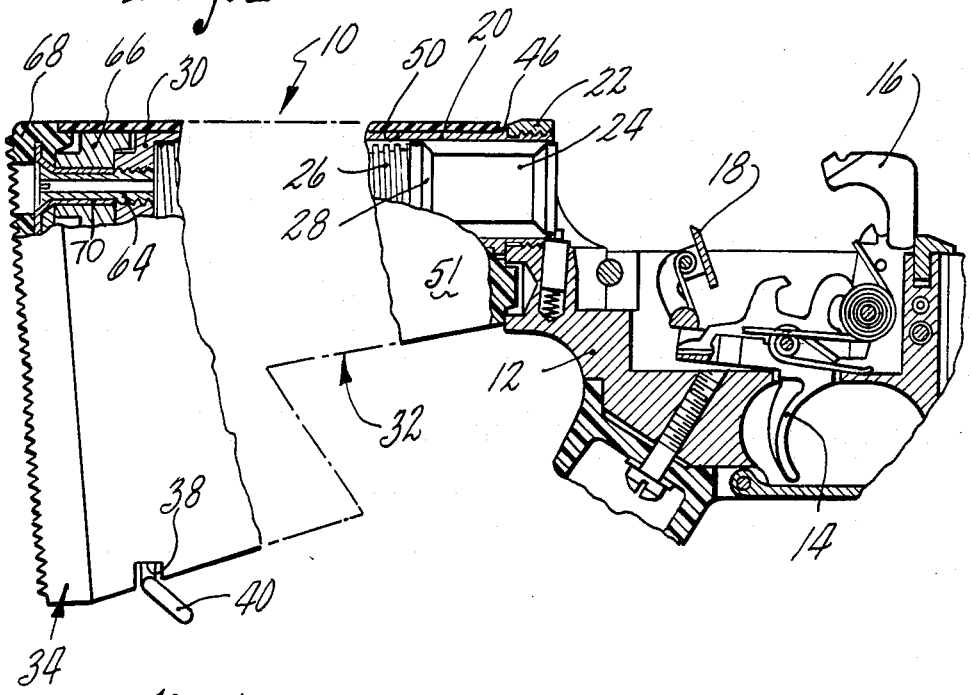
FIG. 1 is a fragmented longitudinal sectional view of an M-16 type rifle incorporating a buttstock assembly of the invention.
Figure 2:
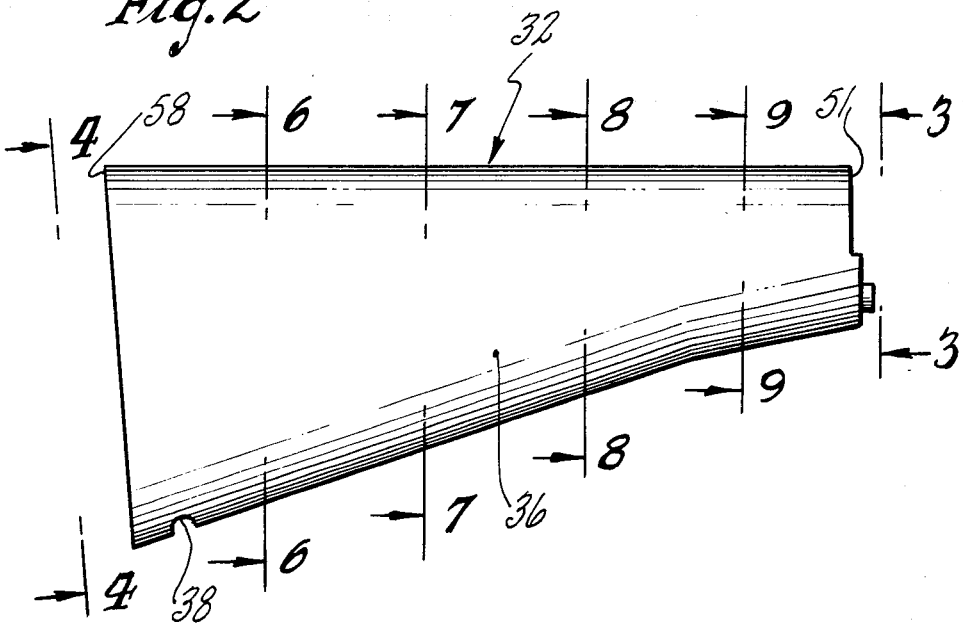
FIG. 2 is a side elevational view of the buttstock, per se.

Referring to FIG. 1, there is shown an M-16 rifle incorporating a buttstock assembly of the invention, generally designated 10. The buttstock assembly is attached to the lower receiver 12 (which embodies a firing mechanism comprising a trigger 14, hammer 16 and automatic sear 18). The lower receiver 12 has the usual tubular rear extension 20 projecting therefrom which is in threaded engagement at its forward end with an attachment ring 22 integral with the lower receiver 12. Within the lower receiver extension 20 is mounted a standard buffer 24, as described in U.S. Pat. No. 3,366,011, and an operating spring 26 which engages a flange 28 on the buffer and seats against the base 30 of the tubular extension 20. The buttstock assembly 10 includes a buttstock, generally indicated at 32, and a composite butt plate 34 (discussed hereinafter) securely fastened on the enlarged butt end thereof. In general, the buttstock assembly 10 is similar to that of U.S. Pat. No. 3,618,248 and is of an oval cross-sectional configuration, as will be appreciated from FIGS. 3 and 4.

Figures 3, 4, 5, 6, 7, 8, 9:
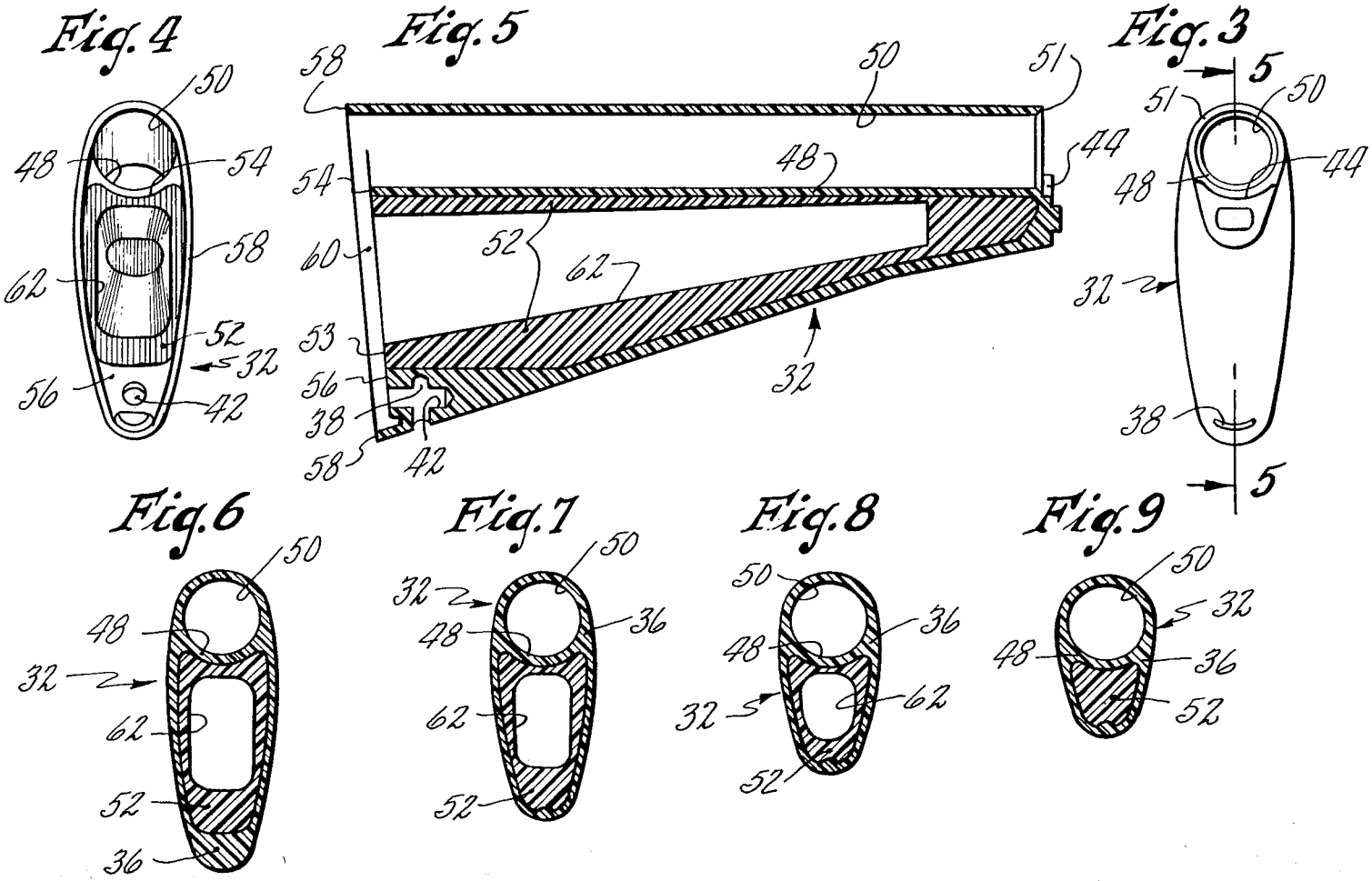
FIGS. 3 and 4 are front end and rear end views, respectively, of the buttstock of FIG. 2, taken along the lines 3—3 and 4—4 of FIG. 2.
FIG. 5 is a longitudinal sectional view of the buttstock, taken substantially along the line 5—5 of FIG. 3.
FIGS. 6, 7, 8 and 9 are transverse sectional views of the buttstock, taken at various stations along the respective lines 6—6, 7—7, 8—8 and 9—9 of FIG. 2.

With reference to FIGS. 2–9, which depict the buttstock 32, per se, it will be seen that the buttstock 32 is partially constituted by an exterior shell 36 of high-impact thermoplastic, such as that sold under the trademark Zytel. Such material renders the buttstock more resistant to breakage than it would otherwise be if materials such as certain thermosett plastics were employed. The shell 36 is provided with a small transversely extending slot 38 adjacent the butt end for receiving a swivel 40 (FIG. 1). As shown in FIG. 5, the shell 36 also has a longitudinally extending bore 42 in intersecting relationship with the slot 38 for enabling a butt plate retaining fastener (not shown) to be inserted in the bore 42 in threaded connection to the swivel 40. Turning to FIGS. 1, 3 and 5, the front end of the shell will be observed as having defined a curved surface 44 which confronts the lower periphery of an annular flange 46 on the receiver extension 20. As best shown in FIGS. 4–9, the shell incorporates an integral longitudinally extending web or rib 48 which extends from the front of the shell and terminates short of the butt end. The web 48 has a semi-circular cross-section and functions to define, with the inner periphery of the upper portion of the shell 36, a cylindrical through volume or aperture 50 for receiving the lower receiver extension 20. The volume 50 is surrounded at its entrance by a circular lip 51 which is defined by the upper portion of the shell 36 and the web 48. The rear surface of the flange 46 is in abutting relationship with the lip 51 as shown in FIG. 1.

The interior space under the web in the shell 36 is filled with a hard core 52 of molded polyurethane foam or polyester foam which terminates in a vertically extending surface 53 short of the butt end and is flush with the rear edge 54 of the web 48 and the vertically extending surface 56 of shell 36. The terminal lip 58 of the shell 36, the vertically extending surfaces 53 and 56 and the rear edge 54 of the web 48 together define the boundaries of a recess 60. The core 52 is molded so as to provide a centrally located stowage compartment 62 having a generally triangular shape with its enlarged entrance opening communicating with the recess 60. The central stowage compartment 62 tapers inwardly from its opening at the recess 60 and terminates within the shell 36 adjacent its forward end. This compartment is suited for stowage of appropriate cleaning and servicing equipment necessary to maintain the rifle.

The butt plate 34, which is attached to the rear end of the shell 36, is received within the recess 60. Although reference should be had to aforementioned U.S. Pat.

No. 3,618,248 for a more complete description of the butt plate 34, a brief discussion thereof will be provided herein. The butt plate 34 encloses the recessed butt end of the buttstock 10 and is held in secure engagement therewith by both the fastener (not shown) secured to the swivel 40 and a bolt 64 threadably connected to the end of the receiver extension 20. Interposed between the butt plate 34 and the rear end of the receiver extension 20 in the cylindrical volume 58 is an aluminum spacer 66 through which the bolt 64 extends.

The butt plate 34 includes frame member 68. The frame member 68 is received within the recess 60 of the buttstock 10 and is provided with a peripheral flange for engaging the lip 58 of the shell 36 to provide for secure sealing of the butt plate 34 against the shell 36. Butt plate 34 embodies an opening (not shown) in alignment with the opening to the stowage compartment and covered by a door (not shown). A steel latch keeper 70 for latching the door is permanently bonded within the interior of the frame 68 of the butt plate and is shaped to accommodate the head of the bolt 64.

When the rifle is impacted in any attitude on the buttstock 10, the web 48 functions to cause more evenly distributed loads to be transmitted to the lower receiver 12 by the extension 20, thereby lessening the likelihood of damage to the lower receiver.

Obviously, many modifications and variations are possible in light of the above teachings without departing from the scope or spirit of the invention as defined in the appended claims.

I claim:

1. In a buttstock for a rifle having a tubular lower receiver extension which buttstock is of the type having: a hollow shell of plastic material having a generally triangular shape with an oval-shaped cross-section which progressively increases in area in the longitudinal direction from the front end to the butt end of the buttstock, an inner core of different plastic material and a cylindrical volume defined in the buttstock for receiving the receiver extension, the improvement comprising:

an interior web of generally semi-circular cross-section integral with and forming a part of the shell, the web extending longitudinally such that the concave surface of the web defines the cylindrical volume together with the inner periphery of the upper portion of the shell.

2. The improvement of claim 1, wherein the core is in abutting relationship with the convex surface of the web.

3. The improvement of claim 1, wherein the front of the web and the front upper portion of the shell define an annular lip.

* * * * *

UNITED STATES PATENT AND TRADEMARK OFFICE

CERTIFICATE OF CORRECTION

PATENT NO. : 4,512,101

DATED : April 23, 1985

INVENTOR(S) : Harold J. Waterman, Jr.

It is certified that error appears in the above-identified patent and that said Letters Patent are hereby corrected as shown below:

On the title page;

Change the assignee from "Chandler Evans Inc" to --Colt Industries Operating Corp--.

Signed and Sealed this

First Day of October 1985

[SEAL]

*Attest:*

DONALD J. QUIGG

*Attesting Officer*

*Commissioner of Patents and Trademarks—Designate*